United States Patent [19]

Columbus

[11] 4,370,407

[45] Jan. 25, 1983

[54] PHOTOGRAPHIC PRODUCTS INCLUDING LIQUID SPREADING MEANS

[75] Inventor: Richard L. Columbus, Rochester, N.Y.

[73] Assignee: Eastman Kodak Company, Rochester, N.Y.

[21] Appl. No.: 282,616

[22] Filed: Jul. 13, 1981

Related U.S. Application Data

[63] Continuation of Ser. No. 143,230, Apr. 24, 1980, abandoned.

[51] Int. Cl.[3] ..... G03C 5/54; G03C 1/76; G03C 1/40; G03C 5/24

[52] U.S. Cl. ..... 430/403; 430/207; 430/496; 430/499

[58] Field of Search ..... 430/207, 208, 209, 496, 430/497, 499, 403

[56] References Cited

U.S. PATENT DOCUMENTS

| | | | |
|---|---|---|---|
| 2,982,650 | 5/1961 | Land | 430/207 |
| 3,069,266 | 12/1962 | Land | 430/207 |
| 3,138,459 | 6/1964 | Land | 430/207 |
| 3,221,942 | 12/1965 | Glass | 430/499 |
| 3,342,600 | 9/1967 | Downey | 430/208 |
| 3,352,674 | 11/1967 | Harvey | 430/208 |
| 3,541,938 | 1/1970 | Harvey | 430/208 |
| 3,652,282 | 3/1972 | Land | 430/209 |
| 3,672,272 | 6/1972 | Cole | 430/497 |
| 3,672,273 | 6/1972 | Nerwin | 430/209 |

FOREIGN PATENT DOCUMENTS 21692 of 1908 United Kingdom .

*Primary Examiner*—Richard L. Schilling
*Attorney, Agent, or Firm*—John B. Turner

[57] ABSTRACT

A photographic film unit which includes first and second superposed sheets, and is processable by distributing a liquid between the sheets, is provided with liquid directing means that present a greater resistance to liquid flow in a longitudinal direction than in a transverse direction. Transverse barrier ridges, which are small compared to the depth of the liquid, are positioned between the sheets to inhibit the flow in the predetermined direction while flow continues uninhibited or is enhanced in the transverse direction along the ridges. Other embodiments employ stripes having different degrees of hydrophobicity.

16 Claims, 8 Drawing Figures

PHOTOGRAPHIC PRODUCTS INCLUDING LIQUID SPREADING MEANS

This application is a continuation of application Ser. No. 143,230, filed Apr. 24, 1980, now abandoned.

FIELD OF THE INVENTION

The present invention relates to photographic film units that are adapted to be processed by distributing a liquid processing composition between two layers of the unit, and more specifically to such a film unit that includes means for spreading the processing liquid between the layers in a controlled manner.

Film units of this type are frequently called self-processing film units, but it should be understood in connection with the present specification that they do not necessarily include a supply of the processing liquid. The liquid can, instead, and preferably is applied to the film units from another source, such as in a camera, film pack, or processing mechanism.

BACKGROUND OF THE INVENTION

Photographic film units are well known that can be processed almost immediately after their exposure even by amateur users who have little understanding of how it is done. Typically such film units comprise first and second superposed sheets which comprise layers for receiving a processing liquid therebetween. One of the sheets may include a layer of photosensitive material in which the latent image is recorded and that is processable by the liquid to form the final picture. The other sheet serves to confine the liquid and facilitate its distribution over the photosensitive material. In most commercial film units of this type, the processing liquid is supplied in a containment pouch disposed at one end of the film unit. Processing is initiated by progressively advancing the film unit between a pair of pressure rollers which rupture the pouch, expel its liquid contents between the sheets and drive the liquid across the imaging area. A spacer separates the sheets and controls the quantity of the distributed liquid that is available to the imaging area for processing.

For numerous reasons known to those skilled in the art, the processing liquid should completely cover the imaging area to a predetermined uniform depth. Moreover, such coverage should be obtainable regardless of the orientation of the film unit relative to horizontal, over a wide range of temperatures and without reliance on particular skills of the user.

Because of difficulties previously encountered in handling inviscid liquids, the usual practice has been to add a thickener to the processing liquid. Although inviscid liquids may flow more easily, like water, they are considered difficult to control during spreading particularly when the orientation of the film unit and the resulting effects of gravity are not predetermined. Highly viscous liquids, on the other hand, are considered easier to control and remain essentially immobile after spreading regardless of the orientation of the film unit.

Attempts have been made, of course, to improve the typical film units referred to above, both in the manner of applying the processing liquid to the imaging area and in the manner of distributing the liquid. Workers in the art have sought, for example, to eliminate the liquid pouch used to supply the processing composition, thereby to simplify the design and manufacture of the film units. The pouch is usually positioned in one border of the film unit, making the border both thicker and wider than desired. Its elimination would permit a film unit of uniform thickness and having borders that are uniform in width. Similarly, proposals have been made for using inviscid processing liquid to reduce the forces required to spread the liquid or to eliminate the pressure rollers presently used for that purpose.

U.S. Pat. No. 2,982,650 (issued May 2, 1961 to Land) and No. 3,069,266 (issued Dec. 18, 1962 to Land), for example, describe "pouchless" diffusion transfer photographic film units in which a low viscosity liquid composition is drawn from a reservoir and distributed between two sheets by capillary action. Prior such attempts have not, however, overcome the drawbacks already mentioned. The liquid is applied to the film unit along one edge of the film unit in a manner that is undesirably sensitive to the orientation of the film unit. Additionally, liquid flow is induced entirely by capillary action, which may be satisfactory in some applications, but is undesirably slow in others.

Still other approaches using low-viscous liquids in relatively small transparency units are disclosed in U.S. Pat. Nos. 3,541,938 (issued Nov. 24, 1970 to Harvey) and 3,352,674 (issued Nov. 14, 1967 to Harvey). In these approaches the liquid is injected between the sheets through a syringe or from a small blister pouch that, at least insofar as the application of the liquid is concerned, does not appear to be orientation sensitive. However, no means are suggested for controlling the flow of the liquid once it is injected between the sheets. Instead, a camera mechanism engages the sheets to distribute the liquid with internal pressure. Although satisfactory for their intended purposes, these approaches are difficult to apply to larger formats and require undesirably complex camera mechanisms. In addition, the film unit itself must be capable of containing the liquid under pressure and then, presumably, releasing any excess of the liquid after processing.

SUMMARY OF THE INVENTION

In accordance with the present invention, a photographic film unit, including first and second superposed layers and processable by distributing a liquid between the layers, is provided with flow controlling means for overcoming many of the disadvantages previously encountered in distributing low viscosity liquid. The flow controlling means is positioned to be contacted by the liquid as it flows between the layers to present a greater resistance to liquid flow in a predetermined direction compared to a transverse direction. Liquid flow is inhibited in the predetermined direction or enhanced in the transverse direction to augment the quantity of liquid flowing in the transverse direction.

In the preferred embodiment the flow controlling means comprise barriers to flow in the form of spaced parallel ridges which extend in the transverse direction and are positioned to be contacted by the liquid flowing between the layers. When the liquid flowing in the predetermined direction contacts a ridge, it tends to move along the ridge before it crosses the ridge. In this manner, as the liquid moves from ridge-to-ridge, a relatively square wavefront is maintained. In an alternative embodiment, the flow controlling means comprise stripes that have different degrees of hydrophilicity or hydrophobicity and that extend in the transverse direction on the surface of one or both of the layers. Alternate stripes retard liquid flow in the predetermined direction to enhance the flow along the stripes in the transverse direction.

The flow controlling means has particular utility in a film unit that has a small access port for introducing the processing liquid into a space between the layers and an opposed venting port for releasing air as it is displaced from the space by the liquid. In such a film unit, the flow controlling means assists in directing the liquid from the small source into a wavefront that extends across the full width of the film unit and then advances in a relatively square wavefront along the length of the film unit.

DETAILED DESCRIPTION OF THE PREFERRED AND ALTERNATIVE EMBODIMENTS

Figure 1:
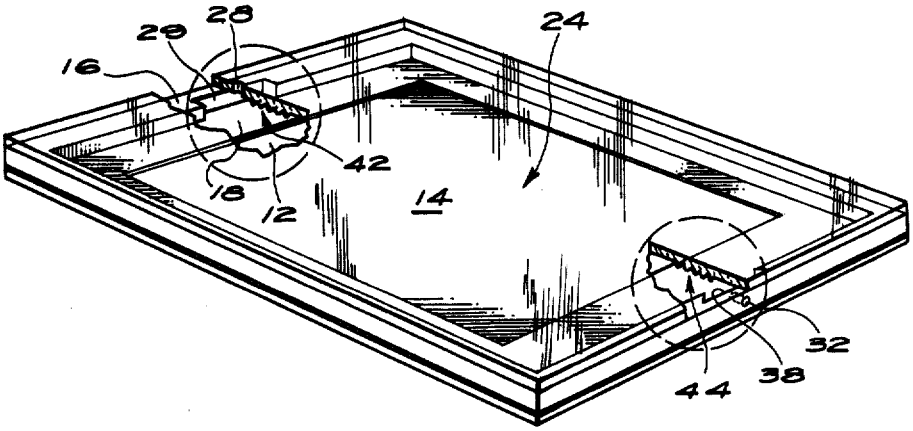
FIG. 1 is a perspective view of a film unit in accordance with a preferred embodiment of the present invention including liquid flow controlling means comprising parallel ridges extending transversely in a border area of the film unit.
Figure 2:
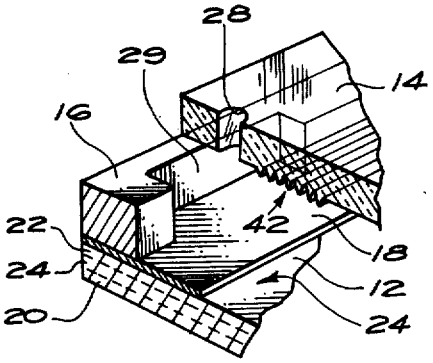
FIG. 2 is an enlarged cut-away view of a first end portion of the film unit illustrated in FIG. 1 and depicting the transverse ridges and border area in more detail.
Figure 3:
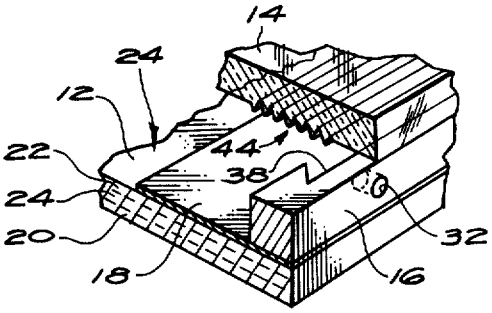
FIG. 3 is an enlarged cut-away view of a second end portion of the film unit illustrated in FIG. 1, opposite the first end portion, and depicting the transverse ridges and border area in more detail.

Referring first to FIGS. 1–3, a preferred embodiment of a film unit in accordance with the present invention is depicted comprising a photosensitive sheet 12 and a cover sheet 14 that are coupled together in closely-spaced superposed relationship by a spacer 16 and mask 18. In use, the film unit is adapted to be exposed to a scene and processed by a liquid to form a photographic print representing the scene. The liquid is introduced into the space between the sheets and is distributed there to initiate the processing of the film unit and to bring about the formation of the print.

More specifically, the photosensitive sheet 12 includes a support 20 and layers 22 of photosensitive emulsions that are suitable for recording a latent image. During processing the latent image is developed in a manner that brings about the release of an imagewise distribution of dyes that migrate by diffusion transfer to an image-receiving layer 24. There the dyes are immobilized for viewing as the final print. The photosensitive layers are exposable from one face of the film unit, through the cover sheet 14, which is made transparent for that purpose, while the print is viewable from the other face, through support 20, which is also transparent. Further details of the processing chemistry are not considered necessary to the present disclosure, but are ascertainable from various commercially available instant film products such as Kodak's PRIO Instant Color Film, and from descriptions such as Vol. 151, Item No. 15162 (Nov. 1976) of *Research Disclosure,* published by Industrial Opportunities, Ltd., Homewell, Havant, Hampshire, PO9 1EF, England.

The mask 18 is secured to the photosensitive sheet around the perimeter thereof to create a border frame surrounding imaging area 24. When the film unit is exposed, the latent image is formed in the emulsion layers within this imaging area. Similarly, during processing, the liquid outside of the imaging area is blocked by the mask to create a distinct white border surrounding the final picture.

The spacer 16 extends substantially entirely around the perimeter of the film unit, and is secured to the mask on one side and to the cover sheet on the other side to space the photosensitive and cover sheets apart by a predetermined amount.

Considered together, the above-mentioned parts comprise a layered structure in which two of the layers are spaced apart for receiving the processing liquid therebetween. This space is substantially entirely closed by the sheets, the mask and spacer, to prevent the escape of the liquid once it has been introduced between the layers.

While the space between the sheets is substantially closed, liquid delivery means in the form of an access port 28 is provided in a border region at one end of the film unit for introducing the processing liquid into the space between the sheets. Similarly, a venting port 32 is provided in the border area at the end opposite the access port for releasing air that is displaced from between the sheets by the liquid. As depicted in FIG. 1, the access port is a relatively small aperture extending through the cover sheet. The aperture is small enough so any gravitationally induced hydraulic head will be insignificant, and the processing liquid can be introduced in a manner that is substantially unaffected by the orientation of the film unit. At the same time, however, the aperture is large enough to permit sufficient liquid flow to quickly fill the space between the sheets when coupled to an outside source of the processing liquid. The venting port, on the other hand, can be smaller, so long as it is large enough, and is positioned to release the displaced air. As depicted in FIG. 1, a pocket 38 is located in the spacer 26 adjacent the venting port to trap liquid before it reaches the vent. Of course, other more elaborate schemes could be employed to trap the liquid.

Thus, although the film unit is intended to contain the introduced liquid without leaking, it is not airtight and need not stand up to liquid pressures other than those that may be used to induce liquid flow.

The processing liquid is a low viscosity solution having handling characteristics much like water, with a viscosity in the range of 0 to 250 cps., for example, and is formed like presently available commercial processing liquids, but without the thickener. The liquid is introduced through the access port, from which it spreads outwardly to fill the space between the two sheets. Such spreading can be achieved solely by capillary action, but in the preferred embodiment, it is augmented by introducing the liquid under slight pressure, such as 0 to 3 psig. In addition to spreading the liquid more quickly, within several seconds for a typical film unit, the pressure differential provides some assistance in maintaining the spacing between the sheets in the imaging area so flexible sheets can be employed without collapsing against each other.

Should a uniform depth of the processing liquid be important in connection with some processing chemistries, it can be accomplished by using relatively thick sheets having sufficient rigidity so they will remain flat and evenly spaced. In another approach, the sheets can be backed on one or both sides by flat surfaces in the camera or film container. The sheets can be drawn to such surfaces by vacuum, for example, or pushed against the surfaces by the internal pressure of the processing liquid. Further details of a mechanism for supporting the sheets during processing are disclosed in commonly assigned copending U.S. Pat. application Ser. No. 143,229, entitled FILM PACK and filed in my name on even date herewith.

Figure 4:
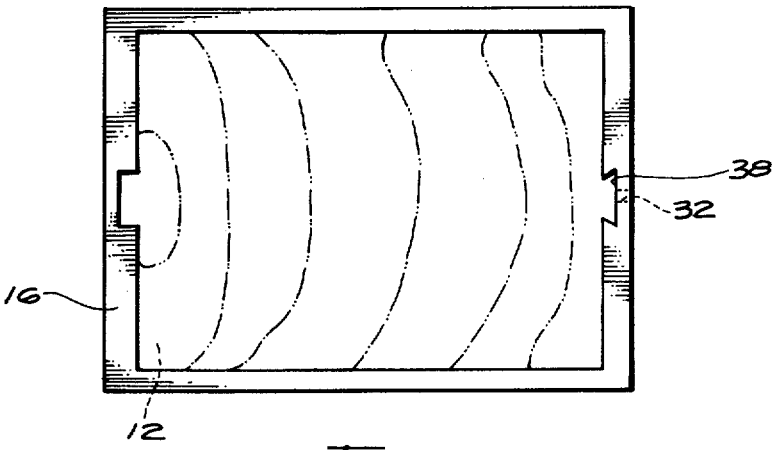
FIG. 4 is a schematic view of the film unit illustrated in FIG. 1 depicting an example of a pattern of flow of the liquid as it progresses from one end of the film unit to the other.

Referring now more specifically to FIGS. 2 and 4, spreading means are provided in the space between the sheets for controlling the flow of the liquid as it moves from the access port across the imaging area to the venting port. The flow is controlled by liquid directing means that present a greater resistance to the flow of the liquid in a predetermined direction compared to a transverse direction without completely blocking the flow of liquid at any point. In the disclosed embodiment the predetermined direction is longitudinally along the film unit from the end of the film unit that contains the access port to the end that contains the venting port. The transverse direction is across the film unit. Referring to FIGS. 1–3, the directing means comprise two series of ridges 42 and 44 extending transversely of the film unit at its opposite ends in the border regions. At the leading end, adjacent the access port, the ridges are disposed between the access port and the imaging area. At the trailing end the ridges are between the imaging area and the venting port.

When the liquid is introduced into the space between the sheets it flows away from the access port to the first ridge. The ridge then acts temporarily as a barrier to liquid flow in the longitudinal direction, inhibiting flow across the ridge. Instead, at least some of the liquid is diverted to flow along the ridge, or transversely of the film unit, until the space on the upstream side of the ridge is entirely filled. The liquid then spills past the ridge and proceeds to the next barrier ridge where the process is repeated. It is entirely possible that some liquid may move over a ridge before the space upstream of the ridge is entirely filled. Still, however, the tendency for the liquid to flow transversely is sufficient to significantly augment its lateral flow. This enhances the flow pattern in the sense of forming a wavefront that is less likely to entrap air or to miss a portion of the imaging area. It also makes more liquid available to portions of the imaging area that are relatively far from the access port, such as along the lateral edges.

FIG. 4 depicts the wavefront at various stages in its progress along the film unit. The set of ridges 42 at the first end of the film unit enhance the wavefront between the access port and the imaging area. From there, the wavefront proceeds across the imaging area to the second set of ridges 42 at the second end. At the second end, any deterioration of the wavefront that may have occurred in the imaging area is corrected to ensure that the trailing end of the imaging area will be adequately covered, and to smooth the wavefront.

Numerous techniques are available for forming the ridges, including grooving the sheets between the locations desired for the ridges. In a film unit having overall dimensions of 3 inches by 4 ½ inches (7.62 by 11.43 centimeters), for example, the sheets might be spaced apart by 1 to 5 mils (25 to 125 microns), and have ridges that are 0.28 to 4 mils (7 to 100 microns) high with a pitch of approximately 1 mil (25 microns). Although the ridges may extend into the space between the sheets, they do not entirely block fluid flow and do not deplete more than an insignificant amount of the processing liquid from the location of the directing means. It has been found that small ridges, say in the range of 0.28 to 0.35 mils (7–9 microns) are adequate when capillary forces are the sole motivating force, and that ridges of larger size are preferable when a pressure differential is employed to move the liquid.

In this preferred embodiment, the ridges have been located only in border areas where they will not degrade the exposure or viewing of the imaging area. It should be understood, however, that the ridges could extend entirely across the imaging area. In some applications, the ridges may not be considered objectionable in the imaging area, either because they are relatively small or because in a particular film format, the imaging area is both exposed and viewed from the opposite face of the film unit.

Figure 5:
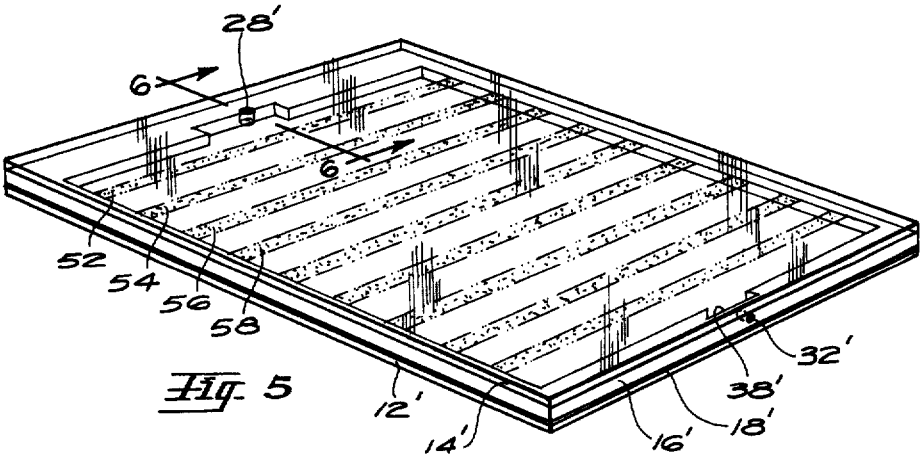
FIG. 5 is a perspective view of an alternative embodiment of a film unit in accordance with the present invention including flow controlling means comprising spaced transverse stripes in one of the film unit layers which differ in surface characteristics from the portions of the layer between the stripes.
Figure 6:
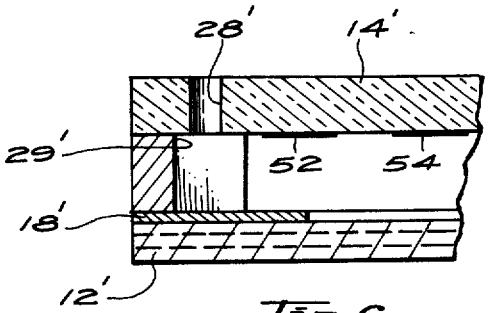
FIG. 6 is an enlarged cross-sectional view of a portion of the film unit illustrated in FIG. 5, depicting one of the stripes in more detail.

Referring now to FIGS. 4–5, an alternative embodiment is depicted where the directing means comprise parallel stripes of different degrees of hydrophobicity or hydrophilicity extending transversely of the film unit in the imaging area. Stripes 52, 54, 56 and 58, etc., are more hydrophobic than the surfaces between the stripes, to present greater resistance to liquid flow in the longitudinal direction than in the transverse direction. The resistance differential is the result of an increase in the resistance to flow in the predetermined direction, a decrease in the resistance to flow in the transverse direction, or both. It can be accomplished by suitable surface treatments, that roughen the surface, for example, so it has a different texture in striped patterns. Preferably, however striped coatings of materials are applied to one or both of the sheets to change the interaction between the liquids employed and the film unit surfaces.

Figure 7:
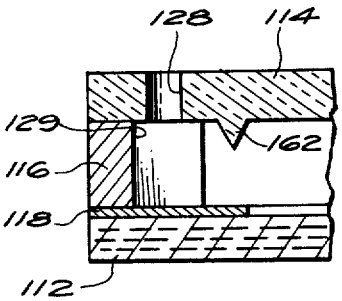
FIG. 7 is a partial cross-sectional view of another alternative embodiment of the film unit, corresponding to the enlarged cut-away view of FIG. 2, and depicting a film unit having a single ridge in one end border.

FIG. 7 depicts a second alternative embodiment which is similar in many respects to the film unit illustrated in FIG. 1, except that only a single ridge 162 is provided and the ridge extends somewhat further, approximately, one third of the way, into the space between the sheets, FIG. 7 corresponds essentially to FIG. 2, and shows the ridge 162 extending transversely across at least most of the width of the film unit in the border area adjacent access port 128'. As in the preferred embodiment, the liquid will flow essentially radially outwardly from the access port until the wavefront engages the ridge 162. At that point the ridge acts as a barrier presenting a resistance to further longitudinal flow while the liquid continues to move transversely along the ridge to fill the space between the sheets upstream of the ridge and to establish a wavefront that extends across the entire width of the imaging area. The liquid spills over the ridge and proceeds across the imaging area.

Figure 8:
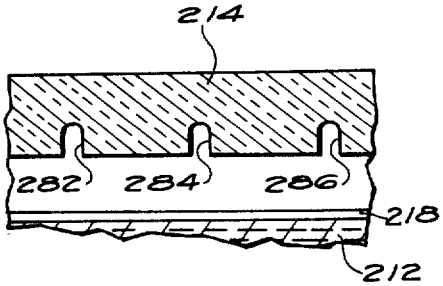
FIG. 8 is a partial cross-sectional view of another alternative embodiment of the film unit depicting rows of recesses as the flow controlling means.

Yet another embodiment is depicted in FIG. 8, comprising recessed stripes 282, 284 and 286 extending transversely across the film unit much like the stripes 52, 54, 56 and 58 in FIG. 5. The recesses are approximately 0.4 mils (10 microns) deep and 1.6 mils (40 microns) across.

It should now be apparent that a film unit in accordance with the present invention provides significant advantages not available from the teaching of the prior art. Fluid flow is controlled in a film unit by directing the liquid in desired directions without significantly depleting liquid from the area occupied by the control means. Fluid applied to the film unit at a point source is quickly redistributed to extend across the full width of the film unit for enhanced coverage of the imaging area. Low viscosity liquids are employed, while minimizing gravitational effects on the liquid flow, so the distribution of the liquid is relatively insensitive to the orientation of the film unit.

The invention has been described in detail with particular reference to certain preferred embodiments thereof, but it will be understood that variations and modifications can be effected within the spirit and scope of the invention.

I claim:

1. A photographic film unit processable by a low viscosity liquid, said film unit comprising:

a first sheet having an imaging portion processable by the liquid;

a second sheet superposed with said first sheet in closely spaced relationship;

means for introducing the processing liquid into the space between said sheets to flow between said sheets and process said imaging portion; and liquid directing means contactable by the liquid in said space for presenting to said liquid a resistance to flow in a predetermined direction that is greater than the resistance to flow in a transverse direction, to tend to cause the liquid to establish a continuous transversely extending wavefront which flows over said directing means in the predetermined direction, said liquid directing means comprising at least one ridge on one of said sheets extending in the transverse direction, said ridge having a height which is less than the spacing between the sheets to inhibit liquid flow in the predetermined direction without entirely blocking such flow.

2. A photographic film unit processable by a low viscosity liquid, said film unit comprising:

a first sheet having an imaging portion processable by the liquid;

a second sheet superposed with said first sheet in closely spaced relationship;

means for introducing the processing liquid into the space between said sheets to flow between said sheets and process said imaging portion; and liquid directing means contactable by the liquid in said space for presenting to said liquid a resistance to flow in a predetermined direction that is greater than the resistance to flow in a transverse direction, to tend to cause the liquid to establish a continuous transversely extending wavefront which flows over said directing means in the predetermined direction, said liquid directing means comprising generally parallel spaced stripes on a surface on one of said sheets extending in the transverse direction, said stripes having hydrophobicity different from that of said surface.

3. A photographic film unit processable by a low viscosity liquid, said film unit comprising:

a first sheet including an imaging portion to be contacted by the liquid;

a second sheet coupled to said first sheet in closely spaced relationship therewith to establish a space between said sheets for receiving the liquid in contact with said imaging portion;

means having a small aperture for introducing the liquid into said space at one end of said film unit to establish a continuous liquid wavefront flowing outwardly away from the aperture in one direction and toward the opposite end of said film unit; and means within said space for establishing a resistance to liquid flow in said one direction which is greater than the resistance to flow in a transverse direction and which tends to augment spreading of the liquid in said transverse direction, thereby to reduce curvature of the wavefront flowing outwardly from the aperture and to distribute the processing liquid in a continuous liquid layer, said resistance means being transparent and in overlaying relationship with said imaging portion and comprising at least one elongate stripe on the surface of one of said sheets said stripe having a hydrophobicity greater than that of said surface.

4. A photographic film unit processable by a low viscosity liquid, said film unit comprising:

a first sheet including an imaging portion to be contacted by the liquid;

a second sheet coupled to said first sheet in closely spaced relationship therewith to establish a space between said sheets for receiving the liquid in contact with said imaging portion;

means having a small aperture for introducing the liquid into said space at one end of said film unit to establish a continuous liquid wavefront flowing outwardly away from the aperture in one direction and toward the opposite end of said film unit; and means within said space for establishing a resistance to liquid flow in said one direction which is greater than the resistance to flow in a transverse direction and which tends to augment spreading of the liquid in said transverse direction, thereby to reduce curvature of the wavefront flowing outwardly from the aperture and to distribute the processing liquid in a continuous liquid layer, said resistance means being transparent and in overlaying relationship with said imaging portion and comprising a plurality of parallel barriers on the surface of one of said sheets that present temporary resistance to fluid flow across said barrier.

5. A self processing photographic film unit comprising:

a first layer having an imaging to be contacted with a liquid processing solution, a second layer positioned in spaced relationship with said first layer to establish a space for processing solution between said layers, said layers being spaced apart a distance effective to establish capillary flow of said processing solution in said space, and liquid directing means in said space for inhibiting the flow of the processing solution in a predetermined direction to augment the flow transversely of said predetermined direction to fill said space and thereby cause substantially uniform contact of said processing solution with said portion.

6. A film unit as claimed in claim 5 wherein said liquid directing means comprises at least one barrier to capillary flow on the surface of one of said layers within said space, said barrier extending across said space to form a channel between said barrier and the end of said space whereby the capillary flow of processing composition will fill said channel to establish a wavefront and then progress across said barrier and along said space.

7. A film unit as claimed in claim 6 wherein said barrier comprises at least one elongate ridge on the surface of one of said layers.

8. A film unit as claimed in claim 6 wherein said barrier comprises at least one elongate stripe on the surface of one of said layers said stripe having a hydrophobicity greater than that of said surface.

9. A film unit as claimed in claim 6 wherein said barrier comprises a row of protrusions on the surface of one of said layers.

10. A photographic film unit processable by a low viscosity liquid, said film unit comprising:

a first sheet having an imaging portion processable by the liquid;

a second sheet superposed with said first sheet in closely spaced relationship;

means for introducing the processing liquid into the space between said sheets for flow between said sheets to process said imaging portion; and liquid directing means contactable by the liquid in said space for presenting to said liquid a resistance to flow in a predetermined direction that is greater than the resistance to flow in a transverse direction, to tend to cause the liquid to establish a continuous transversely extending wavefront which flows over said directing means in the predetermined direction, said liquid directing means comprising resistance means on one of said sheets and extending in the transverse direction, said resistance means having a height which is less than the spacing between the sheets to inhibit liquid flow in the predetermined direction without entirely blocking such flow.

11. A photographic film unit processable by a processing liquid having a viscosity in the range of 0 to 250 centipoises, said film unit comprising:

a first sheet having an imaging portion processable by the liquid;

a second sheet superposed with said first sheet and bounding with said first sheet a space for the processing liquid;

means for introducing the processing liquid into said space for spreading in both the lateral and longitudinal directions within said space to process said imaging portion; and resistance means extending in said lateral direction and contactable by the liquid in said space for inhibiting movement of the wavefront of the liquid in said longitudinal direction over the resistance means until the wavefront extends in the lateral direction along the resistance means and for allowing movement of the wavefront between the resistance means and one of said sheets after the wavefront extends in the lateral direction along the resistance means.

12. A photographic film unit as claimed in claim 11, wherein said means for introducing the low viscosity processing liquid is a small port which comprises essentially a point source for introducing the liquid in a manner insensitive to the orientation of the film unit, and wherein said resistance means is disposed between said port and said imaging portion.

13. A photographic film unit as claimed in claim 11, wherein said resistance means comprises at least one ridge on one of said sheets, said ridge having a height which is less than the spacing between the sheets to inhibit movement of the wavefront of the liquid in said longitudinal direction over the ridge without entirely preventing such movement.

14. A photographic film unit as claimed in claim 11, wherein said resistance means comprises generally parallel spaced stripes on a surface of one of said sheets, said stripes extending in said lateral direction and having a hydrophobicity different from that of said surface.

15. A photographic film unit processable by a liquid having a viscosity in the range of 0 to 250 centipoises, said film unit comprising:

a layer having an imaging portion processable by the liquid;

means superposed with said layer for confining processing liquid for flow across said layer to process said imaging portion; and resistance means extending in a first direction and having a height which is less than the spacing between the layer and the superposed means, said resistance means being contactable by the liquid for resisting, without preventing, movement of the wavefront of the liquid over the resistance means in a second direction and thereby augmenting flow of the liquid in said first direction.

16. A method of processing a photographic film unit with low viscosity processing liquid, said method comprising the steps of:

introducing processing liquid having a viscosity in the range of 0 to 250 centipoises into a space between first and second sheets of the film unit for spreading in both the lateral and longitudinal direction within the space to process an imaging portion of one of the sheets, and inhibiting movement of the wavefront of the liquid in the longitudinal direction to the imaging portion until the wavefront extends across the entire width of the imaging portion, transversely of the longitudinal direction.

* * * * *